US010337269B2

(12) United States Patent
Bisset et al.

(10) Patent No.: US 10,337,269 B2
(45) Date of Patent: Jul. 2, 2019

(54) SYSTEM AND METHOD TO INSTALL VELOCITY STRING

(71) Applicants: Stephen Henry Bisset, Kingwood, TX (US); Donald Ingvardsen, Spring, TX (US); Firman Amberg, Huffman, TX (US)

(72) Inventors: Stephen Henry Bisset, Kingwood, TX (US); Donald Ingvardsen, Spring, TX (US); Firman Amberg, Huffman, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 192 days.

(21) Appl. No.: 15/184,669

(22) Filed: Jun. 16, 2016

(65) Prior Publication Data

US 2017/0362907 A1 Dec. 21, 2017

(51) Int. Cl.

| | |
|---|---|
| ***E21B 23/02*** | (2006.01) |
| ***E21B 43/12*** | (2006.01) |
| ***E21B 17/00*** | (2006.01) |
| ***E21B 17/18*** | (2006.01) |

(52) U.S. Cl.

CPC ..... *E21B 23/02* (2013.01); *E21B 17/00* (2013.01); *E21B 17/18* (2013.01); *E21B 43/122* (2013.01)

(58) Field of Classification Search

CPC ..... E21B 23/02; E21B 23/06; E21B 17/00; E21B 17/18; E21B 17/203; E21B 43/10; E21B 43/121; E21B 43/122; E21B 43/123; E21B 43/128; E21B 33/068; E21B 33/03; E21B 34/14; E21B 34/10

See application file for complete search history.

(56) References Cited

U.S. PATENT DOCUMENTS

| | | | | |
|---|---|---|---|---|
| 4,171,018 | A * | 10/1979 | Walker | E21B 43/10 166/196 |
| 2003/0141079 | A1* | 7/2003 | Doane | E21B 23/06 166/387 |
| 2005/0284640 | A1 | 12/2005 | Borak | |
| 2008/0271893 | A1* | 11/2008 | Hill | E21B 33/068 166/305.1 |
| 2012/0186806 | A1* | 7/2012 | Fay | E21B 23/02 166/240 |
| 2012/0261136 | A1* | 10/2012 | Ehtesham | E21B 34/14 166/373 |

(Continued)

FOREIGN PATENT DOCUMENTS

| | | |
|---|---|---|
| EP | 2532830 A2 | 12/2012 |

OTHER PUBLICATIONS

Notification of Transmittal of the International Search Report and the Written Opinion of the International Searching Authority, or the Declaration; PCT/US2017/031639; dated Jul. 28, 2017; 11 pages.

(Continued)

*Primary Examiner* — George S Gray

(74) *Attorney, Agent, or Firm* — Cantor Colburn LLP

(57) ABSTRACT

A velocity string system includes a lock mandrel. A seal bore assembly attached to the lock mandrel runnable in a production string; and a velocity string sealable in the seal mandrel and separately runnable in the production string. A method for installing a velocity string system in a production string.

12 Claims, 2 Drawing Sheets

(56) References Cited

U.S. PATENT DOCUMENTS

| | | | | |
|---|---|---|---|---|
| 2012/0298377 | A1* | 11/2012 | Smith | E21B 23/02 166/380 |
| 2013/0072111 | A1 | 3/2013 | Ellis | |
| 2014/0124199 | A1 | 5/2014 | Gorrara et al. | |
| 2015/0000929 | A1* | 1/2015 | Veeken | E21B 34/10 166/375 |
| 2015/0260010 | A1* | 9/2015 | Lugtmeier | E21B 33/03 166/379 |

OTHER PUBLICATIONS

"Subsurface Flow Control Systems"; Halliburton; Retrieved from the Internet on Nov. 8, 2017; http://www.halliburton.com/public/cps/contents/Books_and_Catalogs/web/CPSCatalog/08_ssfc.pdf; 68 pages.

"Velocity strings in deep tight gas wells"; Oman Central Gas; Sep. 2009—4th European Conference on Gas Well Deliquifcation; 21 pages.

* cited by examiner

SYSTEM AND METHOD TO INSTALL VELOCITY STRING

BACKGROUND

In liquid hydrocarbon recovery operations producing fluid toward an end of life of the well becomes increasingly difficult. One way to enhance recovery is to install what is known in the industry as a velocity string inside of the production tubing of the well. A velocity string is a smaller diameter string that will naturally transport fluid at a higher velocity for a given pressure delta. This is useful to support production.

Operators have used velocity strings for years with positive effect but not all installations occur without problems. In some cases setting and or unsetting the velocity string can be problematic. Any difficulty encountered by an operator translates to lost time and therefore money. Therefore the art is always receptive to alternative apparatus and method to improve efficiency in operations.

BRIEF DESCRIPTION

A velocity string system includes a lock mandrel; a seal bore assembly attached to the lock mandrel runnable in a production string; and a velocity string sealable in the seal mandrel and separately runnable in the production string.

A method for installing a velocity string system in a production string includes running a lock mandrel having a seal bore assembly attached thereto into a production string; landing the lock mandrel on a no-go shoulder of a seating nipple in the production string; actuating a locking dog of the lock mandrel into a locking groove of the seating nipple; lifting the locking mandrel off the no-go shoulder with the locking dog; running a velocity string into the locking mandrel; and seating the velocity string in the seal bore assembly.

A production system includes a velocity string system including: a lock mandrel; a seal bore assembly attached to the lock mandrel and runnable in the production system; and a velocity string sealable in the seal mandrel and separately runnable in the production system.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
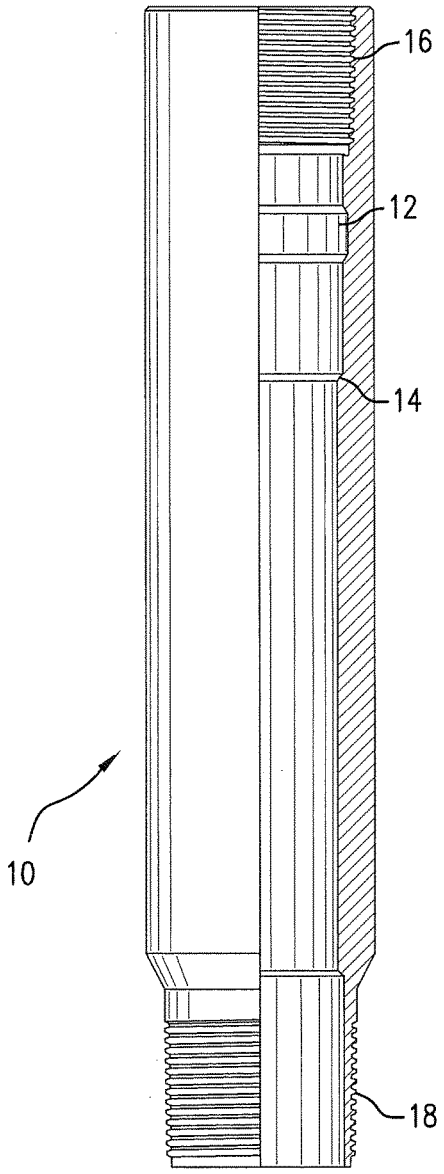
FIG.1 PRIOR ART
FIG. 1 is a three quarter sectional view of a prior art seating nipple.

Referring to FIG. 1, a prior art seating nipple 10 is illustrated. The nipple includes a locking groove 12, a no-go shoulder 14, a box thread 16 and a pin thread 18. The nipple 10 is configured for disposition in a production string 8 that may be used in a downhole environment. The nipple will generally be preexisting in a production string 8 when an operator develops interest in the introduction of a velocity string to improve waning production in an aging well.

Figure 2:
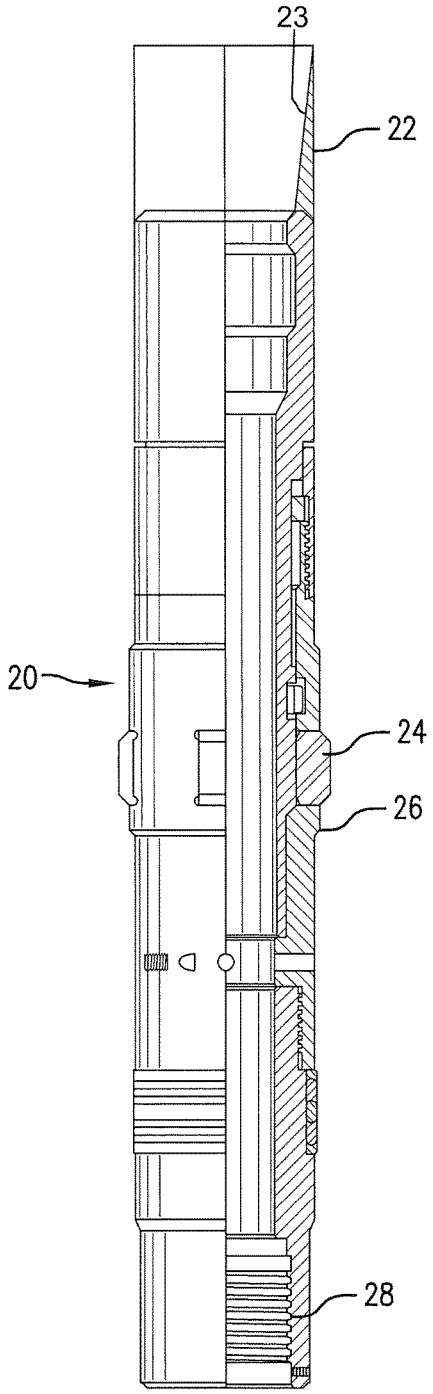
FIG. 2 is a three quarter sectional view of a lock mandrel as disclosed herein.

Referring to FIG. 2, a lock mandrel 20 is illustrated. The mandrel 20 is similar to prior art mandrels but includes an extended tapered entry guide 22 that is not included in the prior art nor would it have a purpose in the prior art. The extended tapered entry guide 22 does however have utility in connection with the system and method as disclosed herein, discussed below. The lock mandrel also includes locking dogs 24, a no-go shoulder 26, and a thread 28 similar to prior art lock mandrels. In use, the lock mandrel 20 is to be run into the production string 8 and into the nipple 10 until the no-go shoulder 26 lands on the no-go shoulder 14 and forward movement stops. The locking dogs 24 are then actuated into the locking groove 12 to support the weight of the lock mandrel 20 and anything hanging therefrom. As taught herein the only thing hanging from the lock mandrel 20 is a seal bore assembly 30 (see FIG. 3).

Figure 3:
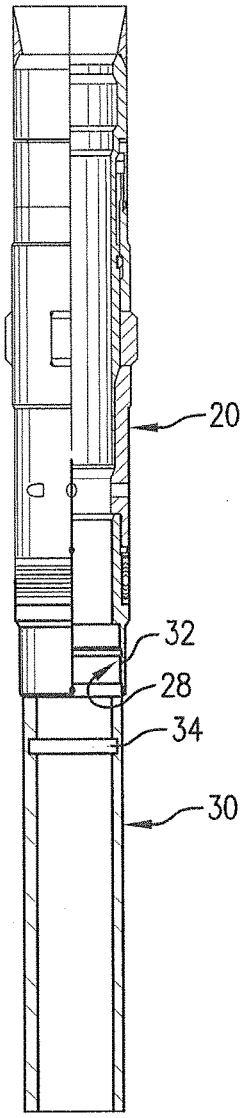
FIG. 3 is a view similar to FIG. 2 but with a seal bore accessory connected to the lock mandrel.

Referring to FIG. 3, the seal bore assembly 30 is illustrated threadedly connected to the lock mandrel 20 by a thread 32 that is complementary to thread 28 in the lock mandrel 20. The seal bore further includes a locking profile 34 configured to locate and retain an after run velocity string.

Still referring to FIG. 3, the locking mandrel in the illustrated condition is run into the prior existing string within a borehole. It is run until the string until it reaches the seating nipple 10 and the no-go shoulder 26 on the lock mandrel 20 contacts the no-go shoulder 14 of the nipple 10. The contact will be felt at surface and the operator is hence alerted that the lock mandrel is in position for the next action. The next action to occur is the actuation of the locking dogs 24 such that they are driven into the locking groove 12 while simultaneously lifting the lock mandrel 20 off the no-go shoulder 14 to a small degree. This will ensure that when the dogs 24 are fully set in groove 12, there will be no weight on the no-go shoulders. A problem of the prior art is that it was often difficult to get weight off the no-go shoulders and this condition resulted in poorly engaged locking dogs and potential difficulty in retrieval of the velocity string at some later date. The configurations as disclosed herein have no such drawbacks.

Figure 4:
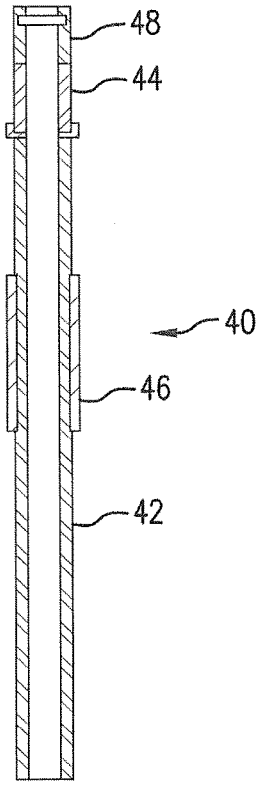
FIG. 4 is a schematic view of a velocity string operable with the lock mandrel of FIG. 3.

After the locking dogs 24 are fully set in the groove 12, a second run is undertaken with the velocity string (illustrated alone in FIG. 4). The velocity string 40 is configured with a string body 42 having a locking mechanism 44 such as a collet, snap ring, etc., a seal 46, and a running profile 48. The running profile enables attachment of the velocity string 40 to a running tool (not shown) to be run to the seal bore assembly 30 for deployment. The locking mechanism 44 is configured to interact with the locking profile 34 to located and secure the velocity string 40 in the seal bore assembly 30, while the seal 46 provides a seal against the seal bore assembly 30. During running, the extended tapered entry guide 22 operates to assist the velocity string into the lock mandrel 20. The extended tapered entry guide 22 presents a tapered entry surface 23 having an angle in the range of 15 to 30 degrees relative to an axis of the lock mandrel 20.

Figure 5:
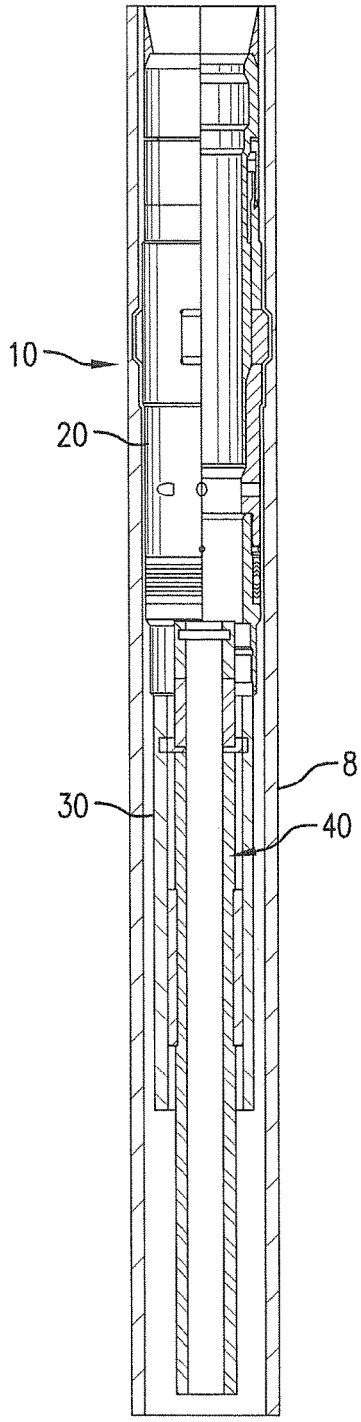
FIG. 5 is a schematic section view of the lock mandrel of FIG. 3 and the velocity string of FIG. 4 in an assembled condition within a string.

Referring to FIG. 5, the velocity string is illustrated in place within the lock mandrel 20 and the nipple 10, which as noted above is a part of the preexisting production string 8 of the borehole.

Set forth below are some embodiments of the foregoing disclosure:

Embodiment 1

A velocity string system comprising: a lock mandrel; a seal bore assembly attached to the lock mandrel runnable in a production string; and a velocity string sealable in the seal mandrel and separately runnable in the production string.

Embodiment 2

The velocity string system of any of the preceding embodiments wherein the lock mandrel includes an extended tapered entry guide.

Embodiment 3

The velocity string system of any of the preceding embodiments wherein the entry guide includes an angled surface in the range of 15 to 30 degrees relative to an axis of the lock mandrel.

Embodiment 4

The velocity string system of any of the preceding embodiments wherein the seal bore assembly is threadedly connected to the lock mandrel.

Embodiment 5

The velocity string system of any of the preceding embodiments wherein the velocity string includes a locking mechanism configured to interact with a locking profile in the seal bore assembly.

Embodiment 6

The velocity string system of any of the preceding embodiments wherein the locking mechanism is a collet.

Embodiment 7

The velocity string system of any of the preceding embodiments wherein the velocity string includes a seal disposed to seat in the seal bore assembly to create a seal.

Embodiment 8

A method for installing a velocity string system in a production string comprising: running a lock mandrel having a seal bore assembly attached thereto into a production string; landing the lock mandrel on a no-go shoulder of a seating nipple in the production string; actuating a locking dog of the lock mandrel into a locking groove of the seating nipple; lifting the locking mandrel off the no-go shoulder with the locking dog; running a velocity string into the locking mandrel; and seating the velocity string in the seal bore assembly.

Embodiment 9

The method of any of the preceding embodiments wherein the running the velocity string includes landing a seal on the velocity string in the seal bore assembly to seal the velocity string to the seal bore assembly.

Embodiment 10

The method of any of the preceding embodiments wherein the running the velocity string includes locking the velocity string to the seal bore assembly with a locking mechanism.

Embodiment 11

The method of any of the preceding embodiments wherein the locking includes engaging a collet.

Embodiment 12

A production system comprising a velocity string system including: a lock mandrel; a seal bore assembly attached to the lock mandrel and runnable in the production system; and a velocity string sealable in the seal mandrel and separately runnable in the production system.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A velocity string system comprising:

a lock mandrel;

a seal bore assembly having a locking profile on an inside surface of the seal bore assembly attached to the lock mandrel runnable in a production string;

a velocity string sealable in the seal bore assembly and separately from the lock mandrel runnable in the production string.

2. The velocity string system as claimed in claim 1 wherein the lock mandrel includes an extended tapered entry guide.

3. The velocity string system as claimed in claim 2 wherein the entry guide includes an angled surface in the range of 15 to 30 degrees relative to a longitudinal axis of the lock mandrel.

4. The velocity string system as claimed in claim 1 wherein the seal bore assembly is threadedly connected to the lock mandrel.

5. The velocity string system as claimed in claim 1 wherein the velocity string includes a lock interactive with the profile in the seal bore assembly.

6. The velocity string system as claimed in claim 5 wherein the lock is a collet.

7. The velocity string system as claimed in claim 1 wherein the velocity string includes a seal disposed to seat in the seal bore assembly to create a seal.

8. A method for installing a velocity string system in a production string comprising:

running a lock mandrel having a seal bore assembly attached thereto into a production string;

landing the lock mandrel on a no-go shoulder of a seating nipple in the production string;

actuating a locking dog of the lock mandrel into a locking groove of the seating nipple;

lifting the locking mandrel off the no-go shoulder with the locking dog; and then running a velocity string into the locking mandrel; and seating the velocity string in the seal bore assembly.

9. The method as claimed in claim 8 wherein the running the velocity string includes landing a seal on the velocity string in the seal bore assembly to seal the velocity string to the seal bore assembly.

10. The method as claimed in claim 8 wherein the running the velocity string includes locking the velocity string to the seal bore assembly with a lock.

11. The method as claimed in claim 10 wherein the locking includes engaging a collet.

12. A production system comprising a velocity string system including:

a lock mandrel;

a seal bore assembly having a locking profile on an inside surface of the seal bore assembly attached to the lock mandrel runnable in a production string;

a velocity string sealable in the seal bore assembly and separately from the lock mandrel runnable in the production system.

* * * * *